US007518587B2

(12) United States Patent
Lee et al.

(10) Patent No.: US 7,518,587 B2
(45) Date of Patent: Apr. 14, 2009

(54) IMPULSE DRIVING METHOD AND APPARATUS FOR LIQUID CRYSTAL DEVICE

(75) Inventors: Ssu-Ming Lee, Taipei County (TW); Seob Shin, Taoyuan (TW); Feng-Ting Pai, Hsinchu (TW); Hsien-Wen Chou, Taoyuan County (TW)

(73) Assignee: Hannstar Display Corporation, Taipei (TW)

( * ) Notice: Subject to any disclaimer, the term of this patent is extended or adjusted under 35 U.S.C. 154(b) by 487 days.

(21) Appl. No.: 10/907,159

(22) Filed: Mar. 23, 2005

(65) Prior Publication Data

US 2005/0253794 A1 Nov. 17, 2005

(30) Foreign Application Priority Data

May 14, 2004 (TW) ..... 93113597 A

(51) Int. Cl.
*G09G 3/36* (2006.01)

(52) U.S. Cl. ..... 345/98; 345/87; 345/92; 345/94; 345/100

(58) Field of Classification Search ..... 345/60, 345/87, 92, 98–100, 94, 204, 211–213, 107, 345/690, 58, 209, 102, 208; 385/147; 315/200 A
See application file for complete search history.

(56) References Cited

U.S. PATENT DOCUMENTS 5,841,412 A * 11/1998 Ebihara ..... 345/58
6,445,372 B1 * 9/2002 Asai ..... 345/99
6,947,034 B2 * 9/2005 Kwon ..... 345/204
7,006,069 B2 * 2/2006 Tanaka et al. ..... 345/98
7,129,922 B2 * 10/2006 Shin ..... 345/90
7,176,873 B2 * 2/2007 Nakamura et al. ..... 345/98
7,215,333 B2 * 5/2007 Chen et al. ..... 345/208
7,224,340 B2 * 5/2007 Pai et al. ..... 345/99
7,256,761 B2 * 8/2007 Huang et al. ..... 345/100
7,327,338 B2 * 2/2008 Moon ..... 345/87
2001/0048432 A1 * 12/2001 Taniai et al. ..... 345/213
2002/0084959 A1 7/2002 Park et al. ..... 345/87
2002/0109654 A1 * 8/2002 Kwon ..... 345/87
2002/0180673 A1 * 12/2002 Tsuda et al. ..... 345/87
2003/0169247 A1 * 9/2003 Kawabe et al. ..... 345/204
2004/0001054 A1 * 1/2004 Nitta et al. ..... 345/204
2004/0027323 A1 * 2/2004 Tanaka et al. ..... 345/98
2004/0041774 A1 * 3/2004 Moon ..... 345/99
2004/0085280 A1 * 5/2004 Kim ..... 345/97
2004/0145554 A1 * 7/2004 Yu ..... 345/87
2004/0169618 A1 * 9/2004 Nakai et al. ..... 345/1.1
2004/0169626 A1 * 9/2004 Nakamura et al. ..... 345/87
2004/0189583 A1 * 9/2004 Park et al. ..... 345/100

(Continued)

*Primary Examiner*—Prabodh M. Dharia
(74) *Attorney, Agent, or Firm*—Jianq Chyun IP Office

(57) ABSTRACT

An impulse driving method and apparatus thereof for a liquid crystal display (LCD) are provided. The gate driver of the liquid crystal device generates first scan signals for controlling gate lines of the liquid crystal device according to the received first start vertical signal and first output enable signal. The scan signals are generated corresponding to the pixel data signals outputted from the data driver of the LCD. Moreover, the gate driver of the LCD generates second scan signals according to the received second start vertical signal and second output enable signals. The scan signals are generated corresponding to black data signals output from the data driver of the liquid crystal device. Therefore, the control signal scheme is simplified and the black insertion ratio is easily controlled.

18 Claims, 4 Drawing Sheets

U.S. PATENT DOCUMENTS

2004/0217931 A1* 11/2004 Shin ..... 345/90
2005/0030272 A1* 2/2005 Hosaka ..... 345/92
2005/0122284 A1* 6/2005 Gates et al. ..... 345/60
2005/0168491 A1* 8/2005 Takahara et al. ..... 345/690
2005/0200579 A1* 9/2005 Chen et al. ..... 345/87
2005/0259063 A1* 11/2005 Kwon ..... 345/98
2005/0259064 A1* 11/2005 Sugino et al. ..... 345/102

* cited by examiner

IMPULSE DRIVING METHOD AND APPARATUS FOR LIQUID CRYSTAL DEVICE

CROSS-REFERENCE TO RELATED APPLICATION

This application claims the priority benefit of Taiwan application 93113597, filed on May 14, 2004, a full disclosure of which is incorporated herein by reference.

BACKGROUND OF THE INVENTION

1. Field of the Invention

The present invention relates to a liquid crystal device, and more particularly, to an impulse driving method and apparatus thereof for a liquid crystal device.

2. Description of Related Art

A liquid crystal display (LCD) is broadly used instead of a cathode radiation tube (CRT) in recent time. As semiconductor technology development advances, an LCD is superior in low power consumption, lightness in weight, high resolution, high hue saturation, prolonged lifetime, etc. Therefore, an LCD is broadly used in electronic products such as laptop computer, desktop computer and LCD television. Wherein the quality of a liquid crystal panel dominates the quality of the LCD.

Referring to FIG. 1, a conventional TFT LCD is shown. Wherein, a plurality of data lines 112~118 is driven by the data driver 110 for outputting data signals of the driving pixels. A plurality of gate lines 132~138 (i.e. scan lines) is driven by the gate driver 130. The display area 120 comprises a plurality of transistors 152~168 and storage capacitors 181~197.

A conventional operation of the impulse LCD comprises the steps of driving a gate line, e.g. gate line 132, for turning on all transistors 152~156 along the gate line 132, and inputting pixel data signal via data lines 112~118 for charging storage capacitors 181~185. Next, a next gate line is driven, e.g. gate line 134, and pixel data signal to be displayed via data lines 112~118 is inputted for driving storage capacitors 187~191. Similarly, storage capacitors 181~197 of the display area 120 are charged sequentially, and an entire image is displayed.

Obviously, the operation method is suitable for static image display, yet when displaying rapid dynamic images, image dragging may occur since storage capacitors are not being promptly charged/discharged. In order to eliminate image dragging, usually an impulse driving LCD is used for simulating operation mode of a cathode radiation tube for avoiding image dragging when displaying dynamic images.

Referring to FIG. 2, a time chart of operating a gate driver of a conventional LCD panel is shown. The operative timing is disclosed by Hitachi Co., wherein black insertion method is used for simulating pulse driving of a gate driver. In FIG. 2, STV represents a start vertical signal of the gate driver, CPV represents a gate clock signal of the gate driver, OE1, OE2 and OE3 respectively represent output enable signal of different drive IC of the gate driver, where OE2 and OE3 are not shown therein. GATE_OUT1, GATE_OUT2, GATE_OUT3 . . . and so on are scanning signals for driving gate lines outputted from the gate driver.

In FIG. 2, STV is triggered with two different enabling states within a scan period T of a frame under impulse driving mode. Accordingly, a scan signal of each of the gate lines is enabled twice, where the first pixel data signal is loaded from the storage capacitors for the first enable operation, whereas black data signal is loaded for black data insertion for the second enable operation. Therefore, the scan period T is divided into two intervals of T1 and T2. The gate clock signal CPV corresponds to output enable signals OE1, OE2 and OE3 for controlling the scan signals outputted from the driver ICs, which drive the gate lines.

During the first time interval T1, since a start vertical signal STV is activated for merely a clock period of the gate clock signal CPV, through the operation of the shift register in the gate driver, the gate lines GATE_OUT1, GATE_OUT2, GATE_OUT3 . . . are sequentially driven, and thus the pixel data outputted from the data driver is directed to the storage capacitors. Moreover, during the second time interval T2, since the start vertical signal STV maintains a period of four gate clock signals CPV, through the operation of the shift register in the gate driver, four gate lines are simultaneously driven, and thus the black data signals from the data driver are fed to the liquid crystal capacitor to clear the voltage of the pixel data signal charged on the liquid crystal capacitor. Impulse driving is thus implemented.

Obviously, the method mentioned above comprises providing different output enable signals OE1, OE2 and OE3 for enabling or disabling scan signals outputted from different driver ICs upon different driver IC structure of the gate driver. The gate lines GATE_OUT1, GATE_OUT2, GATE_OUT3 . . . in FIG. 2 are alternately driven for directing pixel data signal or black data signal outputted from the data driver to storage capacitors. For example, during the time interval T1, i.e. scan period of the pixel data signals, since the gate lines GATE_OUT1, GATE_OUT2, GATE_OUT3 . . . outputted from the driver ICs are controlled by the output enable signal OE1, when the output enable signal OE1 is at low voltage level, the output enable signals OE2 and OE3 have to be at high voltage level that disables the driver ICs. Whereas during the time interval T2, i.e. black data scan period, since the gate lines GATE_OUT1, GATE_OUT2, GATE_OUT3 . . . are controlled by the output enable signal OE1 is at low voltage level, the output enable signals OE2 and OE3 have to be at high voltage level that disables the driver ICs, yet width of the voltage levels vary. Therefore, the different driver ICs of this driving method are controlled respectively by the different output enable signals OE1, OE2 and OE3, and thus control signals are relatively complicated.

Furthermore, merely one start vertical signal STV is used for enabling or disabling scan signals corresponding to output enable signals OE1, OE2 and OE3 outputted from respective driver ICs, such that a time interval T1 is not smaller than T/m, where m is an amount of driver ICs that construct the gate driver. If T1 is assigned as smaller than T/m, a driver IC of the gate driver with merely one output enable signal line is difficult to reach need for enabling and disabling different gate lines at the same time. Consequently, black insertion ratio is significantly limited. For example, when an amount of the driver ICs of the gate driver is 2, the black insertion ratio may not be beyond 50%, whereas when an amount of the driver ICs is 3, the black insertion ratio may not be beyond 33%.

SUMMARY OF THE INVENTION

In the light of the above descriptions, the present invention is directed to an impulse driving method for an LCD, for simplifying controlling signals and manipulating black insertion ratio of the LCD with ease.

The present invention is also directed to an impulse driving apparatus for an LCD, for simplifying controlling signals, and improving system stability and manipulating the black insertion ratio of the LCD with ease.

The present invention is also directed to an impulse driving method for an LCD, wherein a data driver of the LCD sequentially outputs a normal signal and an auxiliary signal for driving pixel. The impulse driving method for the LCD comprises the gate driver of the LCD generating first scan signals of the gate lines of the LCD cooperated with a timing of the normal signal outputted from the data driver according to the first start vertical signal and the first output enable signal. The gate driver of the LCD generating second scan signals of the gate lines of the LCD cooperated with a timing of the auxiliary signal outputted from the data driver according to the second start vertical signal and the second output enable signal. For example, the normal signal is a pixel data signal, and the auxiliary signal is one selected from the black data signal and white data signal that also works instead of black data signal.

Wherein, when the first output enable signal and the second output enable signal are at high voltage level, for example, the data driver outputs the auxiliary data signal to the data line. Therefore, the gate driver stops transmitting the first scan signal controlled by the first output enable signal, and start transmitting a second scan signal controlled by the second output enable signal, e.g. the black data signal is transmitted to the pixel along the scan line to insert the black data. On the contrary, when the first output enable signal and the second output enable signal are at low voltage level, for example, it indicates the data driver is outputting the normal signal to the data line. Therefore, the gate driver stops transmitting the second scan signal controlled by the second output enable signal, so as to start transmitting the first scan signal controlled by the first output enable signal. That is, the pixel data signal is transmitted to the pixel along the scan line to be updated.

Wherein, an impulse of the second start vertical signal is generated at a predetermined period after an impulse of the first start vertical signal is generated. The predetermined period is determined based on the black insertion ratio.

An impulse driving apparatus for an LCD is provided in the present invention. The impulse driving apparatus of the LCD comprises a timing controller, a data driver and a gate driver. Wherein the timing controller serves for outputting pixel data and control signals including the first start vertical signal, the second start vertical signal, the first output enable signal and the second output enable signal. The data driver is coupled to the timing controller serving for receiving pixel data outputted from the timing controller, and sequentially outputting pixel data and black data for driving the pixels of the LCD. The gate driver is also coupled to the timing controller serving for receiving the first start vertical signal and the first output enable signal, generating a first scan signal controlling gate lines of the LCD according to timing of the normal signal outputted from the data driver, and receiving the second start vertical signal and the second output enable signal for generating the scan signal according to timing of the auxiliary signal outputted from the gate driver. Wherein the foregoing pixel data signal is a normal signal, and the black data signal is an auxiliary signal whereas a white signal also works instead of the black data signal.

According to an embodiment of the present invention, when the first output enable signal and the second output enable signal are at high voltage level, for example, the data driver outputs the black data signal to the data line. Thus, the gate driver stops transmitting the first scan signal controlled by the first output enable signal and starts transmitting the second scan signal controlled by the second output enable signal and then transmits the black data signal to the pixels along the scan lines to be inserted black data. On the contrary, when the first output enable signal and the second output enable signal are at low voltage level, for example, the gate driver outputs the pixel data signal to the data lines. Thus, the gate driver stops transmitting the second scan signal controlled by the second output enable signal so as to start transmitting the first scan signal controlled by the first output enable signal, then the pixel data signal is transmitted to the pixels along the scan lines to be updated.

According to an embodiment of the present invention, an impulse of the second start vertical signal is generated at a predetermined period after an impulse of the first start vertical signal is generated, where the predetermined period is determined based on the black insertion ratio to be set.

According to another aspect of the present invention, an impulse driving LCD device is provided, comprising a plurality of gate lines and an impulse driving apparatus. Wherein the impulse driving apparatus comprises a plurality of driver integrated circuits. The impulse driving LCD device comprises that normal data (pixel data) and auxiliary (black data or white data) is charged/discharged by each of the driver integrated circuits according to the first output enable signal and the second output enable signal.

According to the above descriptions, the impulse driving method and apparatus for an LCD in the present invention serves to construct all integrated circuits featuring the gate driver that is controlled by the first output enable signal and the second output enable signal. Whereas all of the integrated circuits are not controlled by the first output enable signal and the second output enable signal in the conventional art. Therefore, controlling signal scheme is simplified. In addition, the first start vertical signal and the second start vertical signal serve to drive pixel data signal and black data signal. Hence the black insertion ratio is manipulated with the predetermined period to be set and is easily controlled.

DESCRIPTION OF EMBODIMENTS

Figure 1:
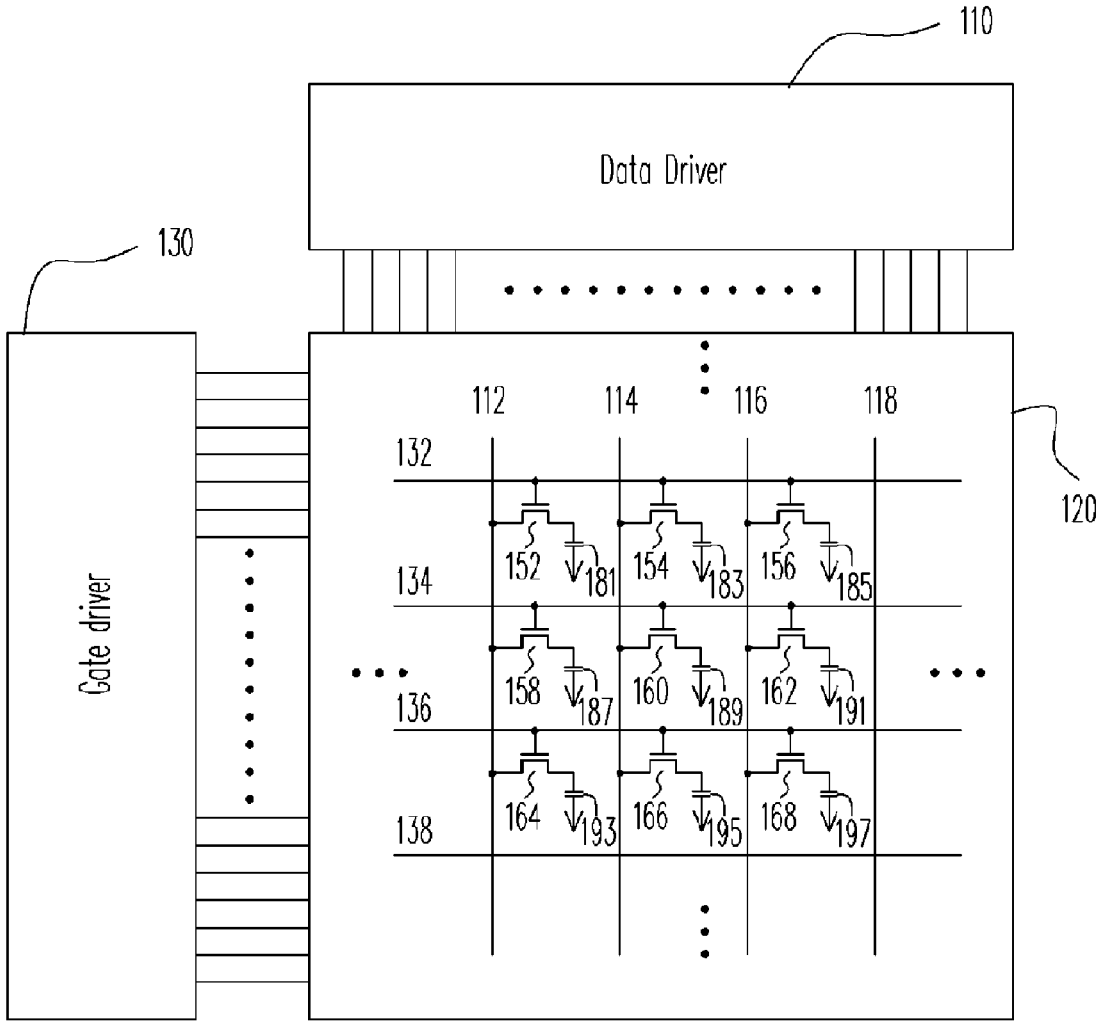
FIG. 1 (PRIOR ART)
FIG. 1 is a schematic diagram illustrating a conventional TFT LCD panel.
Figure 2:
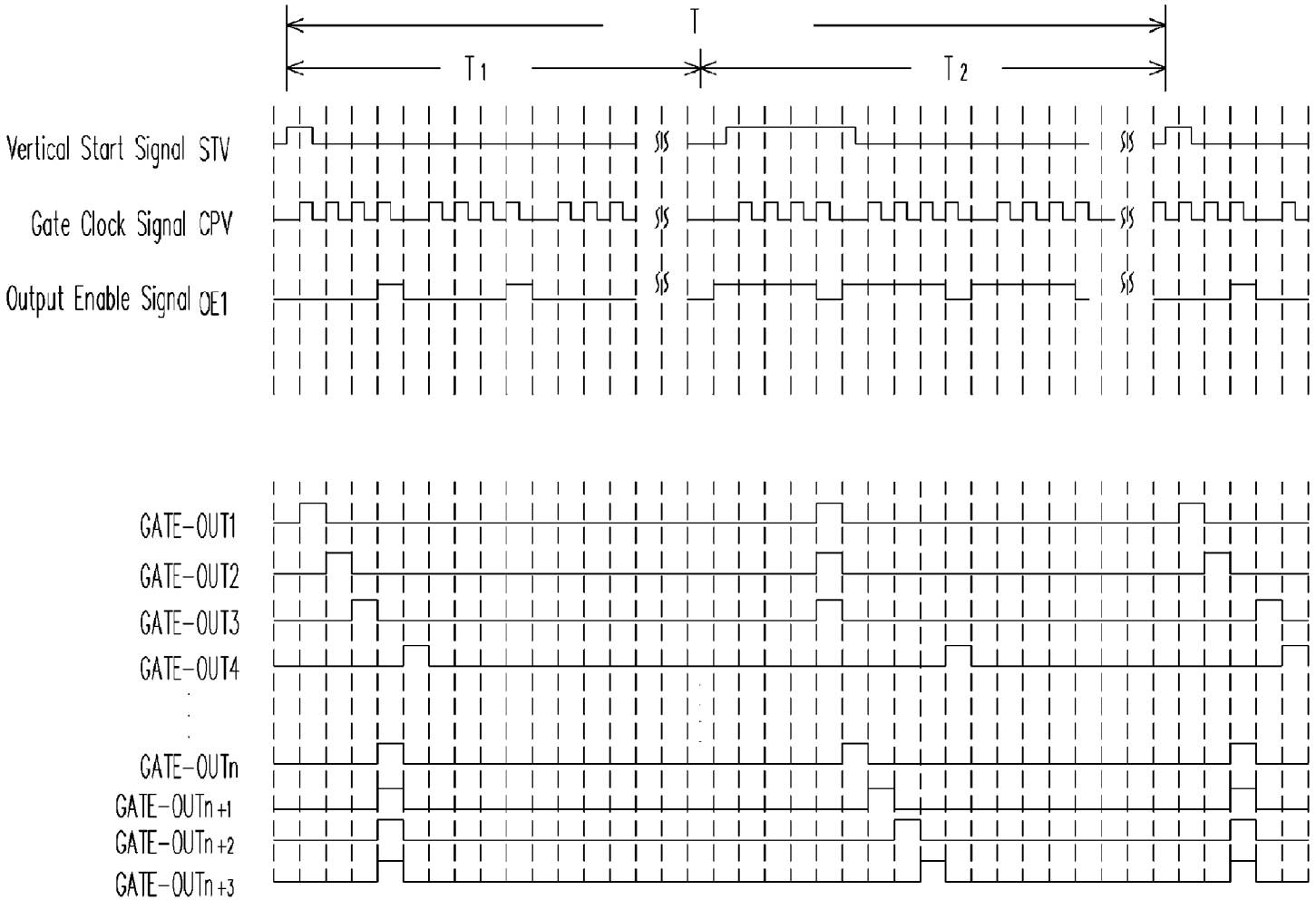
FIG. 2 (PRIOR ART)
FIG. 2 is a schematic waveform diagram illustrating timing of the gate driver of a conventional LCD.
Figure 3:
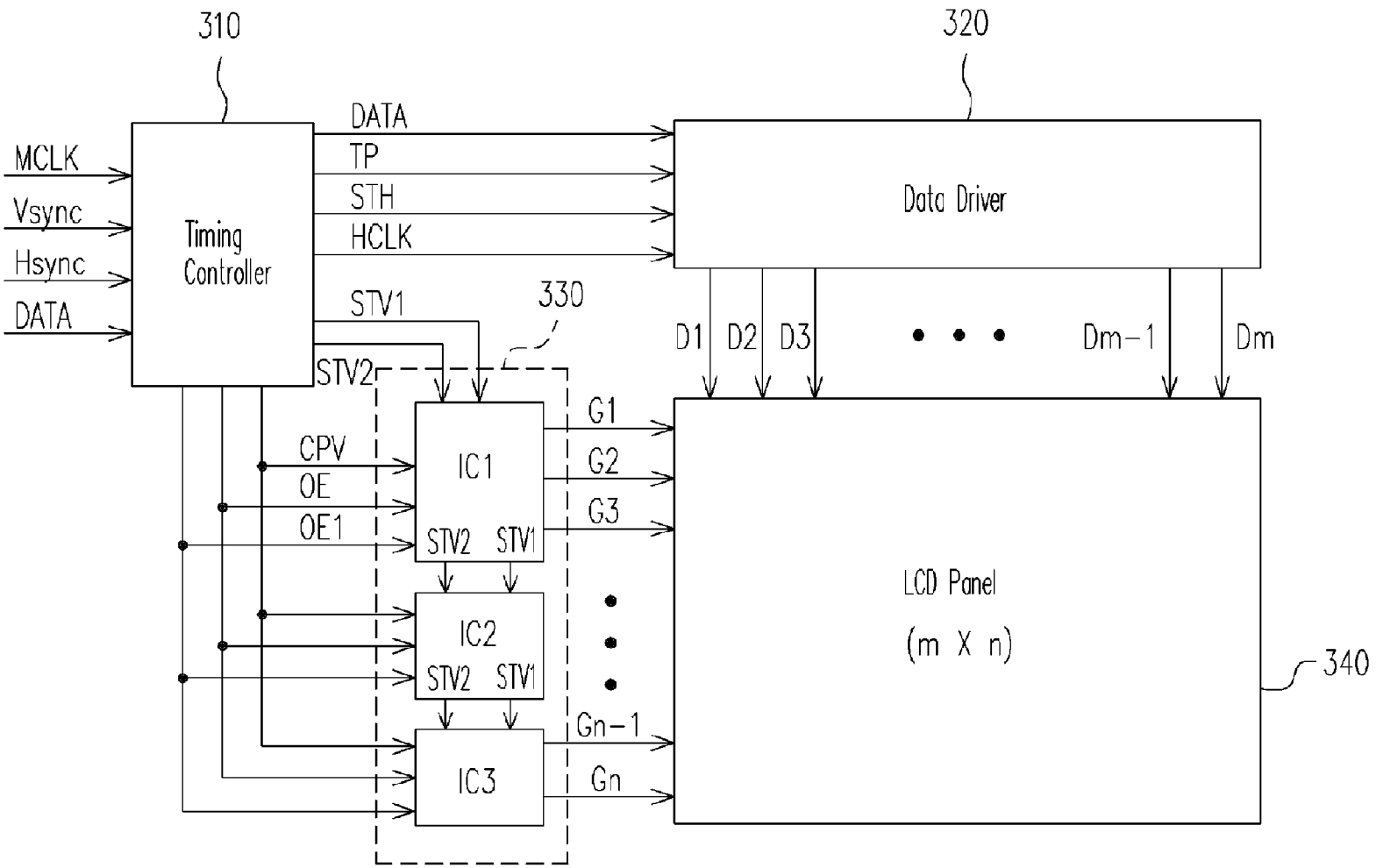
FIG. 3 is a schematic block diagram illustrating an impulse gate driving apparatus of an LCD according to one embodiment of the present invention.

Referring to FIG. 3, a schematic block diagram of an impulse driving apparatus of an LCD according to one embodiment of the present invention is shown. In FIG. 3, the impulse driving apparatus of the LCD comprises a timing controller 310, a data driver 320 and a gate driver 330 for operating with the LCD panel 340 in the driving diagram. The gate driver 330 according to the embodiment comprises at least two driver integrated circuits, e.g. three of IC1, IC2 and IC3 integrated circuits. However, it is to be noted that number of integrated circuits featuring the gate driver 330 is not limited thereto, which varies according to the requirements.

The timing controller 310 is for outputting DATA comprising pixel data, black data, and control signals including a load signal TP, a horizontal start signal STH, a horizontal clock signal HCLK, a first start vertical signal STV1, a second start vertical signal STV2, a gate clock signal CPV, a first output enable signal OE and a second output enable signal OE1.

The data driver 320 is coupled to the timing controller 310 via a DATA signal line for receiving the pixel data and black data outputted from the timing controller 310 and sequentially outputting pixel data signal or black data signal driving pixels of the LCD 340 via the data lines D1~$D_m$ according to other control signals, such as load signal TP, start vertical signal STH, gate clock signal HCLK, etc.

The gate driver 330 is also coupled to the timing controller 310 for generating first scan signals of gate lines G1~Gn of the LCD panel 340 according to the received gate clock signal CPV, the first start vertical signal STV1 and the first output enable signal OE along with pixel data signals outputted from the data driver 320. The gate driver 330 also generates second scan signals of gate lines G1~Gn of the LCD panel 340 according to the timing of the black data signal outputted from the data driver 320 according to the received gate clock signal CPV, the second start vertical signal STV2 and the second output enable signal OE1. The aforementioned gate clock signal CPV serves for selecting gate lines, which is operated in accordance with the timing waveforms in FIG. 4.

Figure 4:
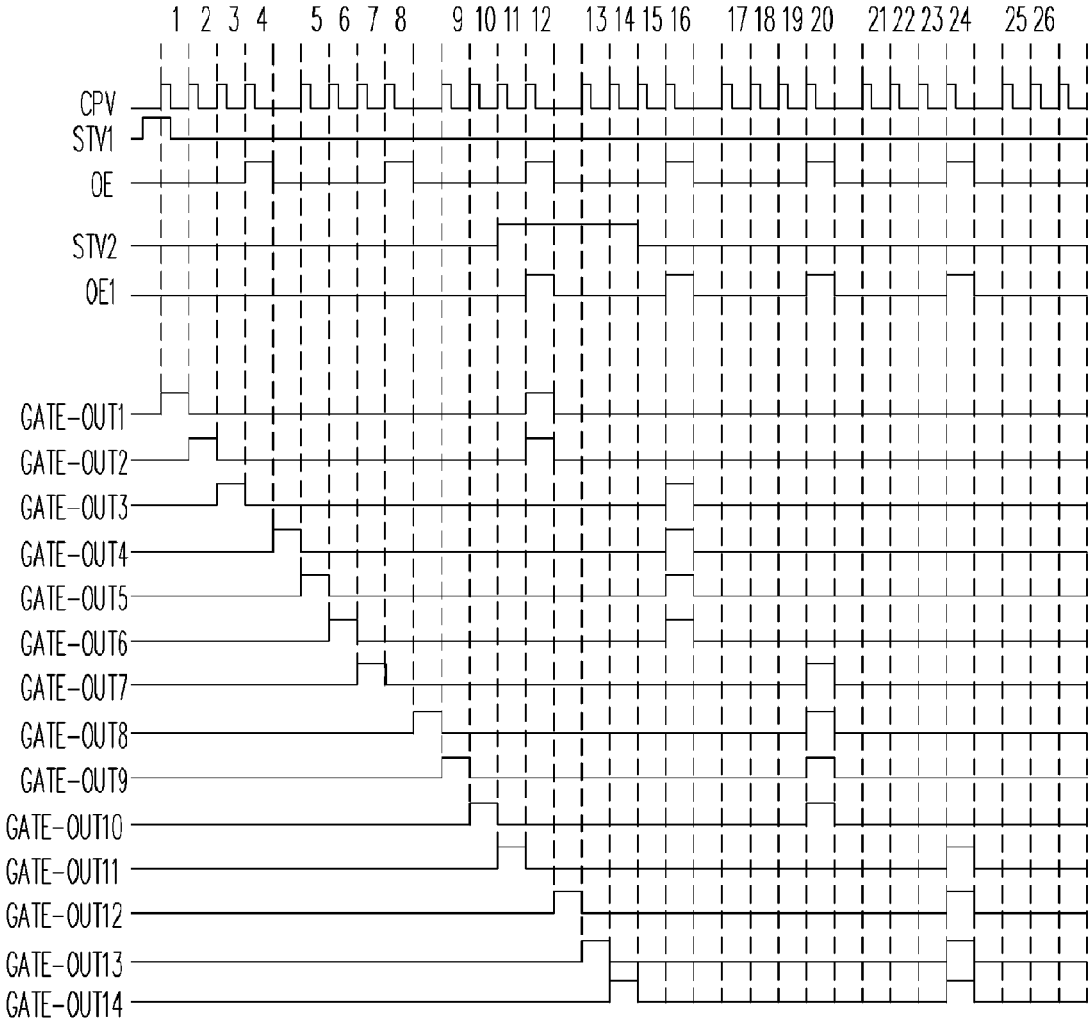
FIG. 4 is a schematic waveform diagram illustrating timing of the gate driver of an LCD according to one embodiment of the present invention.

Referring to FIG. 4 as well as FIG. 3, FIG. 4 illustrates an operation timing chart of a gate driver of an LCD according to one embodiment of the present invention. In FIG. 4, part of the timing waveforms of the scan signals carried with the gates lines G1~G14 outputted from gate driver 330 are illustrated, as well as the first start vertical signal STV1, the second start vertical signal STV2, the first output enable signal OE, the second output enable signal OE1 and gate clock signal CPV, etc.

As illustrated in FIG. 4, as the first clock signal of the gate clock signal CPV is outputted, an impulse of the first start vertical signal STV1 is outputted. Therefore, the gate driver 330 is sequentially shifted and first scan signals are outputted from the gate lines G1~G14 . . . according to the timing of the clock signal CPV, such that pixels along the scan lines of the LCD panel 340 is driven sequentially, and pixel data signals outputted from the data driver 320 are charged to the storage capacitors of the pixels of the LCD panel 340. Wherein, in order to provide proper timing for black data insertion, first scan signals carried by the gate lines G1~G14 . . . are controlled by the first output enable signal OE. According to an embodiment of the present invention, when the first output enable signal OE is at high voltage level, the gate driver 330 stops transmitting first scan signals controlled by the first output enable signal OE, i.e. scan signals shifted according to impulses of the first start vertical signal STV1, the fourth clock signal illustrated in FIG. 4, for example.

Moreover, when the clock signal CPV is the eleventh clock signal, for example, that is an impulse of the second start vertical signal STV2 is generated at a predetermined period after an impulse of the first start vertical signal STV1 is generated. Therefore, the gate driver 330 is sequentially shifted and second scan signals are outputted from the gate lines $G_1$~$G_{14}$ . . . according to the timing of the clock signal CPV, such that pixels along the scan lines of the LCD panel 340 is driven sequentially, and black data signals outputted from the data driver 320 are charged to the storage capacitors of the pixels of the LCD panel 340. According to the embodiment of the present invention, the second start vertical signal STV2 maintains a width of four effective gate clock signal CPV, thus the gate driver 330 drives four gate lines at the same time for charging black data signal outputted from the data driver 320 to the storage capacitance of the pixels of the LCD panel 340, as the $16^{th}$ clock signal shows. Wherein, when the first output enable signal OE and the second output enable signal OE1 are both at high voltage level, the gate driver 330 starts transmitting the second scan signal controlled by the second output enable signal OE1 as well as stops transmitting the first scan signal controlled by the first output enable signal OE. That is, scan signals are sequentially shifted according to the impulses of the second start vertical signal STV2, such that the black data signal outputted from the data driver 320 is applied to the storage capacitance of the pixels of the LCD panel 340, thus black insertion is performed as the $16^{th}$ clock pulse as shown in the figure.

Therefore, the first scan signal of the gate lines of the LCD 340 is generated according to the timing of the pixel data signal outputted from the data driver 320 based on the first start vertical signal STV1 and the first output enable signal OE. The second scan signal of the gate lines of the LCD 340 is generated according to the timing of the black data signal outputted from the data driver 320 based on the second start vertical signal STV2 and the second output enable signal OE1. The first scan signal and the second scan signal are generated sequentially on the same gate line. Therefore, the black insertion ratio can be adjusted by tuning the interval between the impulses of the first start vertical signal STV1 and the second start vertical signal STV2, which is not limited as in the conventional art.

According to the above description, an impulse driving method for an LCD panel is induced. The impulse driving method for the LCD panel comprises the gate driver of the LCD panel generating scan signals of the gate lines for controlling the LCD panel according to the timing of the pixel data signal is outputted from the data driver based on the first start vertical signal and the first output enable signal OE, and the same gate driver of the LCD panel generating other scan signals of the gate lines for controlling the LCD panel according to timing of the black data signal outputted from the data driver based on the received second start vertical signal STV2 and the second output enable signal OE1.

Wherein, when the first output enable signal and the second output enable signal are at high voltage level, for example, the data driver outputs the black data signal to the data lines. Therefore, the gate driver disables the scan signals controlled by the first output enable signal for enabling the scan signal controlled by the second output enable signal, such that black data signal is transmitted to the pixels along the scan line to be inserted with black data. On the contrary, when the first output enable signal and the second output enable signal are at low voltage level, for example, the data driver is outputting pixel data signal to the data lines. Therefore, the gate driver disables the scan signals controlled by the second output enable signal, for enabling the scan signal controlled by the first output enable signal, such that pixel data signal is transmitted to the pixels along the scan line to be updated.

Wherein, an impulse of the second start vertical signal is generated at a predetermined period after an impulse of the first start vertical signal is generated, where the predetermined period is determined by the black insertion ratio to be set.

According to the above descriptions, the impulse driving LCD device in the present invention comprises a plurality of gate lines and impulse driving apparatus, where the impulse driving apparatus comprises a plurality of driver integrated circuits. Wherein, pixel data and black data is charged/discharged by each of the driver integrated circuits in accordance with the first output enable signal and the second output enable signal.

Moreover, the foregoing pixel data signal is one out of the normal signal category, which does not limit the scope of the present invention. Similarly, black data signal is one out of the auxiliary signal category, which does not limit the scope of the present invention. That is, white data signal, for example, is also within the scope of the present invention.

Although the invention has been described with reference to a particular embodiment thereof, it will be apparent to those skilled in the art that modifications to the described embodiment may be made without departing from the spirit of the invention. Accordingly, the scope of the invention will be defined by the attached claims and not by the above detailed description.

What is claimed is:

1. An impulse driving apparatus, comprising:

a timing controller, for providing a first and a second output enable signals, a first and a second start vertical signals and a display data;

a data driver, coupled to and controlled by the timing controller, for outputting a normal signal and an auxiliary signal according to the display data; and a gate driver, coupled to the timing controller, for receiving the first and the second output enable signals and the first and the second start vertical signals, wherein:

the gate driver sequentially generates a first scan signal to enable pixels of scan lines in a liquid crystal display (LCD) panel when the first enable signal is in a disabled state, and the data driver correspondingly outputs the normal signal to the enabled pixels of each scan line; and the gate driver generates at least a second scan signal to enable the pixels of a part of the scan lines when the first and the second output enable signals are simultaneously in an enabled state, and the data driver outputs the auxiliary signal to the enabled pixels of the part of the scan lines.

2. The impulse driving apparatus according to claim 1, wherein when the first enable signal is in the disabled state, the second output enable signal is simultaneously in the disable state, thereby the data driver correspondingly outputs the normal signal.

3. The impulse driving apparatus according to claim 1, wherein the second scan signal is generated after the first scan signal at a predetermined period.

4. The impulse driving apparatus according to claim 1, wherein the gate driver stops generating the first scan signal when the first output enable signal is in the enabled state.

5. The impulse driving apparatus according to claim 1, wherein the gate driver sequentially generates the first scan signal according to a gate clock signal provided by the timing controller.

6. The impulse driving apparatus according to claim 5, wherein a number of the second scan signal is determined by an enable time of the second start vertical signal in the gate clock signal.

7. The impulse driving apparatus according to claim 5, wherein the data driver outputs the normal signal and the auxiliary signal according to a load signal, a horizontal start signal and a horizontal clock signal which are provided by a timing controller.

8. The impulse driving apparatus according to claim 5, wherein the first and the second output enable signals and the first and the second start vertical signals are received by four different terminals of the gate driver.

9. The impulse driving apparatus according to claim 5, wherein the normal signal is a pixel data signal, and the auxiliary signal is one of a black data signal and a white data signal.

10. A liquid crystal display (LCD), comprising:

an LCD panel comprising a plurality of scan lines, for display an image, wherein each scan line comprising a plurality of pixels;

a timing controller, for providing a first and a second output enable signals, a first and a second start vertical signals and a display data;

a data driver, coupled to and controlled by the timing controller, for outputting a normal signal and an auxiliary signal according to the display data; and a gate driver, coupled to the timing controller, for receiving the first and the second output enable signals and the first and the second start vertical signals, wherein:

the gate driver sequentially generates a first scan signal to enable the pixels of the scan lines when the first enable signal is in a disabled state, and the data driver correspondingly outputs the normal signal to the enabled pixels of each scan line; and the gate driver generates at least a second scan signal to enable the pixels of a part of the scan lines when the first and the second output enable signals are simultaneously in an enabled state, and the data driver outputs the auxiliary signal to the enabled pixels of the part of the scan lines.

11. The impulse driving apparatus according to claim 10, wherein when the first enable signal is in the disabled state, the second output enable signal is simultaneously in the disable state, thereby the data driver correspondingly outputs the normal signal.

12. The LCD according to claim 11, wherein the second scan signal is generated after the first scan signal at a predetermined period.

13. The LCD according to claim 11, wherein the gate driver stops generating the first scan signal when the first output enable signal is in the enabled state.

14. The LCD according to claim 11, wherein the gate driver sequentially generates the first scan signal according to a gate clock signal provided by the timing controller.

15. The LCD according to claim 14, wherein a number of the second scan signal is determined by an enable time of the second start vertical signal in the gate clock signal.

16. The LCD according to claim 14, wherein the data driver outputs the normal signal and the auxiliary signal according to a load signal, a horizontal start signal and a horizontal clock signal which are provided by a timing controller.

17. The LCD according to claim 14, wherein the first and the second output enable signals and the first and the second start vertical signals are received by four different terminals of the gate driver.

18. The LCD according to claim 14, wherein the normal signal is a pixel data signal, and the auxiliary signal is one of a black data signal and a white data signal.

* * * * *